US008128117B2

(12) United States Patent
Neiley et al.

(10) Patent No.: US 8,128,117 B2
(45) Date of Patent: Mar. 6, 2012

(54) TOOL-FREE ADJUSTABLE BINDING FOR SPORTS BOARD

(75) Inventors: Roger Neiley, Laguna Beach, CA (US); Lucien Vink, Zuid (NL)

(73) Assignee: Flow Sports, Inc., San Clemente, CA (US)

( * ) Notice: Subject to any disclaimer, the term of this patent is extended or adjusted under 35 U.S.C. 154(b) by 577 days.

(21) Appl. No.: 12/135,106

(22) Filed: Jun. 6, 2008

(65) Prior Publication Data

US 2008/0309052 A1 Dec. 18, 2008

Related U.S. Application Data

(60) Provisional application No. 60/934,789, filed on Jun. 14, 2007.

(51) Int. Cl.
*A63C 9/081* (2006.01)

(52) U.S. Cl. ..... 280/618; 280/14.21; 280/607

(58) Field of Classification Search ..... 280/14.21, 280/14.22, 12.24, 607, 613, 617, 618, 620, 280/633, 634
See application file for complete search history.

(56) References Cited

U.S. PATENT DOCUMENTS

| | | | | |
|---|---|---|---|---|
| 5,277,635 | A | 1/1994 | Gillis | |
| 5,667,237 | A | 9/1997 | Lauer | |
| 5,791,678 | A * | 8/1998 | Perlman | 280/618 |
| 5,868,416 | A | 2/1999 | Fardie | |
| 5,890,729 | A | 4/1999 | Bayer et al. | |
| 5,906,388 | A | 5/1999 | Neiley | |
| 5,941,552 | A | 8/1999 | Beran | |
| 5,947,488 | A | 9/1999 | Gorza et al. | |
| 6,007,085 | A | 12/1999 | Rigal et al. | |
| 6,206,403 | B1 * | 3/2001 | Black et al. | 280/618 |
| 6,234,494 | B1 | 5/2001 | Gien | |
| 6,318,749 | B1 | 11/2001 | Eglitis et al. | |
| 6,428,032 | B1 | 8/2002 | Humbel | |
| 6,467,794 | B1 | 10/2002 | De France | |
| 6,499,760 | B1 * | 12/2002 | Tindall et al. | 280/618 |
| 6,520,531 | B1 | 2/2003 | Gien | |
| 6,786,502 | B2 | 9/2004 | Carlson | |
| 6,817,622 | B2 | 11/2004 | Dodge | |

(Continued)

FOREIGN PATENT DOCUMENTS

| | | |
|---|---|---|
| DE | 10015457 | 10/2001 |

(Continued)

OTHER PUBLICATIONS

Derwent abstract for European Patent No. EP 1 138 353; Dialog WPI Accession No. 2001-591598/200167.

(Continued)

*Primary Examiner* — John Walters
(74) *Attorney, Agent, or Firm* — Fred C. Hernandez; Mintz, Levin, Cohn, Ferris, Glovsky and Popeo, P.C.

(57) ABSTRACT

A binding is adapted for coupling footwear, such as a boot, to a sports board. The binding permits easy adjustment of the binding's position on the board, while also allowing for removal of the binding from the board for improved utility of storage or transport. Adjustment, engagement between binding and board, and removal functions may be accomplished without the use of tools or ancillary components. The binding includes a movable coupler element or elements that removably couple to a retaining disc to secure the binding to the retaining disc and the board.

20 Claims, 12 Drawing Sheets

U.S. PATENT DOCUMENTS

| | | | | |
|---|---|---|---|---|
| 6,910,706 | B2 | 6/2005 | Holzer et al. | |
| 6,945,544 | B2 | 9/2005 | Feurer et al. | |
| 7,063,346 | B2 | 6/2006 | Elkington | |
| 7,281,717 | B2 * | 10/2007 | Sacco et al. | 280/14.22 |
| 7,390,010 | B2 | 6/2008 | Elkington et al. | |
| 2001/0015543 | A1 | 8/2001 | Joubert Des Ouches | |
| 2003/0011171 | A1 | 1/2003 | Battustekka | |
| 2003/0116931 | A1 | 6/2003 | Quattro et al. | |
| 2004/0100069 | A1 | 5/2004 | Cumby | |
| 2004/0188983 | A1 | 9/2004 | Scholten | |
| 2005/0093257 | A1 | 5/2005 | Holzer et al. | |
| 2006/0197310 | A1 * | 9/2006 | Fletcher | 280/607 |

FOREIGN PATENT DOCUMENTS

| | | |
|---|---|---|
| DE | 10313342 | 10/2004 |
| EP | 0756882 | 2/1997 |
| EP | 0761261 | 3/1997 |
| EP | 0815905 | 1/1998 |
| EP | 0840640 | 5/1998 |
| EP | 1 138 353 | 2/2001 |
| FR | 2627097 | 8/1989 |
| FR | 2743306 | 7/1997 |
| FR | 2755025 | 4/1998 |
| WO | WO 97/33664 | 9/1997 |
| WO | WO 00/04964 | 2/2000 |
| WO | WO 02/070087 | 9/2002 |
| WO | WO 2005/014126 | 2/2005 |
| WO | WO 2008/001027 | 1/2008 |

OTHER PUBLICATIONS

Derwent Abstract for German Patent No. DE10015457; Dialog Accession No. 10973909.

Derwent Abstract for German Patent No. DE10313342, Dialog Accession No. 14497918.

Derwent Abstract for French Patent No. FR 2627097; Dialog Accession No. 4902316.

Derwent Abstract for French Patent No. FR2743306; Dialog Accession No. 8266837.

Derwent Abstract for French Patent No. FR2755025; Dialog Accession No. 8722451.

* cited by examiner

TOOL-FREE ADJUSTABLE BINDING FOR SPORTS BOARD

REFERENCE TO PRIORITY DOCUMENT

This application claims priority of co-pending U.S. Provisional Patent Application Ser. No. 60/934,789, entitled "BINDING FOR SPORTS BOARD", filed Jun. 14, 2007. Priority of the aforementioned filing date is hereby claimed and the disclosures of the Provisional Patent Application is hereby incorporated by reference in its entirety.

BACKGROUND

The disclosure relates to a device for retaining a foot or boot on a sports apparatus. In particular, the disclosure relates to a binding for receiving and retaining a foot or boot onto a sports apparatus such as a sports board.

A typical sports board binding includes a base plate to support the sole of a user's foot or boot. In the case of a snowboard binding, the binding is attached to a snowboard by coupling the base plate of the binding to a retaining disc that is fixedly mounted on the snowboard. The retaining disc fits within a fixed-size aperture in the binding's base plate such that the base plate is fixed between the retaining disc and the snowboard to retain the binding to the snowboard.

In conventional binding systems, it can often be cumbersome and time consuming to remove a previously-attached binding from a snowboard. Removal of the binding from a snowboard typically requires the use of tools that are used to tighten and untighten screws or other attachment means on the base plate and rental disc. However, in many circumstances, it is necessary to attach and/or detach a binding from a snowboard in a quick and easy manner. For example, there is a growing use of rental bindings where a customer rents a binding that is then attached to the snowboard in a particular orientation for a given customer at the point of use. The rental shop understandably desires to attach and/or detach the rental binding from the renter's snowboard in a quick and easy manner in order to increase throughput of the rental binding process. The need for tools or other cumbersome attachment/detachment mechanisms can be time consuming and slow down the throughput of a rental shop.

EP 0 756 882 A1 proposes a snowboard binding having a U-shaped base plate forming two flexible wings having a longitudinal opening therebetween and a circular aperture for engaging a circular retaining disc. The two wings can be forced against the retaining disc by means of a screw, which is operated by a handle. A similar binding is shown in U.S. Pat. No. 5,941,552. Another approach is shown in U.S. Pat. No. 5,868,416 A, U.S. Pat. No. 6,318,749 B1, U.S. Pat. No. 5,947,488 A, U.S. Pat. No. 5,667,237 A, U.S. Pat. No. 6,520,531 B1, US 2005/0093257 A1, FR 26 27 097 A1, FR 27 43 306 A1, EP 0 815 905 A2, WO 2000/04964 and WO 97/33664.

All these publications disclose a snowboard binding where a releasable locking between a base plate and a fixed retaining disc is made by an additional movable locking member, which is either attached on the base plate or on the retaining disc and which releasable locking member connects the base plate and the retaining disc to each other.

Still another approach is shown in EP 0 840 640 B1, DE 103 13 342 A1, EP 0 761 261 A1 and WO 02/070087 A1, where a retaining disc can be partially lifted vertically from the plane of the base plate to partially release the retaining disc from the base plate by means of a tensioning lever for rotational adjustment of the binding.

Finally, WO 2008/001027 A1, published after the priority date of the present invention, proposes an adjustable snowboard binding having a fixed retaining disc with upwards directed frusto-conical teeth mating with downwards directed frusto-conical teeth on a base plate. The retaining disc has a circular nut below the teeth. On the base plate there is attached a sliding plate, which is positioned under the retaining disc to grip into said circular nut. The sliding plate is connected to a release cable for removing it out of the nut. When the sliding plate is in the release position the base plate can be tilted for disengagement of the teeth of the base plate from the teeth of the retaining disc, permitting a rotational movement of the base plate with respect to the retaining disc.

All these above mentioned snowboard bindings allow a rotational adjustment of the binding but not an easy removal of the whole binding from the snowboard. In addition, some of the above mentioned bindings are relatively complex in structure.

SUMMARY

Therefore, there is a need for a snowboard binding, which allows a tool free rotational adjustment of the binding and which allows removal of the binding (except the retaining disc) from the snowboard without the need of any tools. There is also a need for a binding, which is reliable in operation having a simplified structure and which is easy in handling. There is a further need for mechanisms and methods that permit quick and easy removal of a binding from a sports board. Such mechanisms and methods desirably do not require the use of tools and desirably provide a secure attachment between the binding and the sports board, as well as a quick release of the attachment when removal of the binding is desired. The ability to quickly adjust the orientation of the binding on the board to meet the needs of a given individual is a also a very desirable feature.

In one aspect, there is disclosed a binding for coupling a boot to a sport board, comprising: a base plate adapted to be secured to a sports boot, wherein the base plate can be secured to a sports board via a retaining disc positioned on a sports board; a coupler element to movably couple to the base plate, wherein the coupler element transitions between an engaged state wherein the coupler element provides an interfering engagement between the base plate and retaining disc to prevent the binding from being decoupled from the retaining disc and snowboard, and a disengaged state wherein the coupler element is free from the retaining disc such that the binding can be moved independently of the retaining disc and snowboard; and a locking member coupled to the coupler element, wherein the locking member transitions between a locked state wherein the coupler element is locked in the engaged state, and an unlocked state wherein the coupler element can freely move between the engaged and disengaged states.

In another aspect, there is disclosed a binding for coupling a boot to a sport board, comprising: a base plate adapted to be secured to a sports boot, wherein the base plate can be secured to a sports board via a retaining disc positioned on a sports board; and an orifice at least partially defined by the base plate, the orifice adapted to receive the retaining disc, wherein the size of the orifice can be adjusted so as to decrease the size of the orifice to a size that achieves a locked engagement between the base plate and the retaining disc; and a locking member coupled to the base plate, wherein the locking member can transition to a state that locks the size of the orifice so that the retaining disc is secured to the base plate.

Other features and advantages should be apparent from the following description of various embodiments, which illustrate, by way of example, the principles of the disclosed devices and methods.

DETAILED DESCRIPTION

Disclosed is a binding for coupling footwear, such as a boot, to a sports board. Although described herein in the context of a snowboard binding for use with a snowboard, it should be appreciated that the binding described herein can be used with other types of sports equipment. For example, the binding can be configured for use with boards used in snowboarding, snow skiing, water skiing, snowshoeing, roller skating, and other activities and sports. An exemplary advantageous aspect of the disclosed design is the ability to allow easy adjustment of the binding's position on the board, while also allowing for removal of the binding from the board for improved utility of storage or transport. Adjustment, engagement and removal functions may be accomplished without the use of tools or ancillary components.

In an embodiment, the binding is adapted to couple a snowboard boot to a snowboard. For the purpose of fixing the binding to a snowboard, the binding removably couples to a retaining disc that is attached to the snowboard such that the binding is secured between the retaining disc and the snowboard. The binding includes a movable coupler element or elements that removably couple to the retaining disc to secure the binding to the retaining disc and the snowboard, as described in detail below.

The coupler element(s) can be easily moved from an engaged state, or engaged position, wherein the coupler element(s) at least partially engages the retaining disc to prevent the binding from being removed from the retaining disc and snowboard, to a non-engaged state, or non-engaged position, wherein the coupler element is completely disengaged from the retaining disc and permits removal of the binding from the retaining disc and snowboard. When in the engaged position, the coupler element retains the binding to the retaining disc such that the binding cannot be removed from the retaining disc and snowboard. As described below, the coupler element can be fully engaged or partially engaged with the retaining disc to permit a limited amount of movement or no movement between a base plate of the binding and the retaining disc and snowboard. Advantageously, the retaining disc is non-mechanical in that it does not require any moving components.

Figure 1:
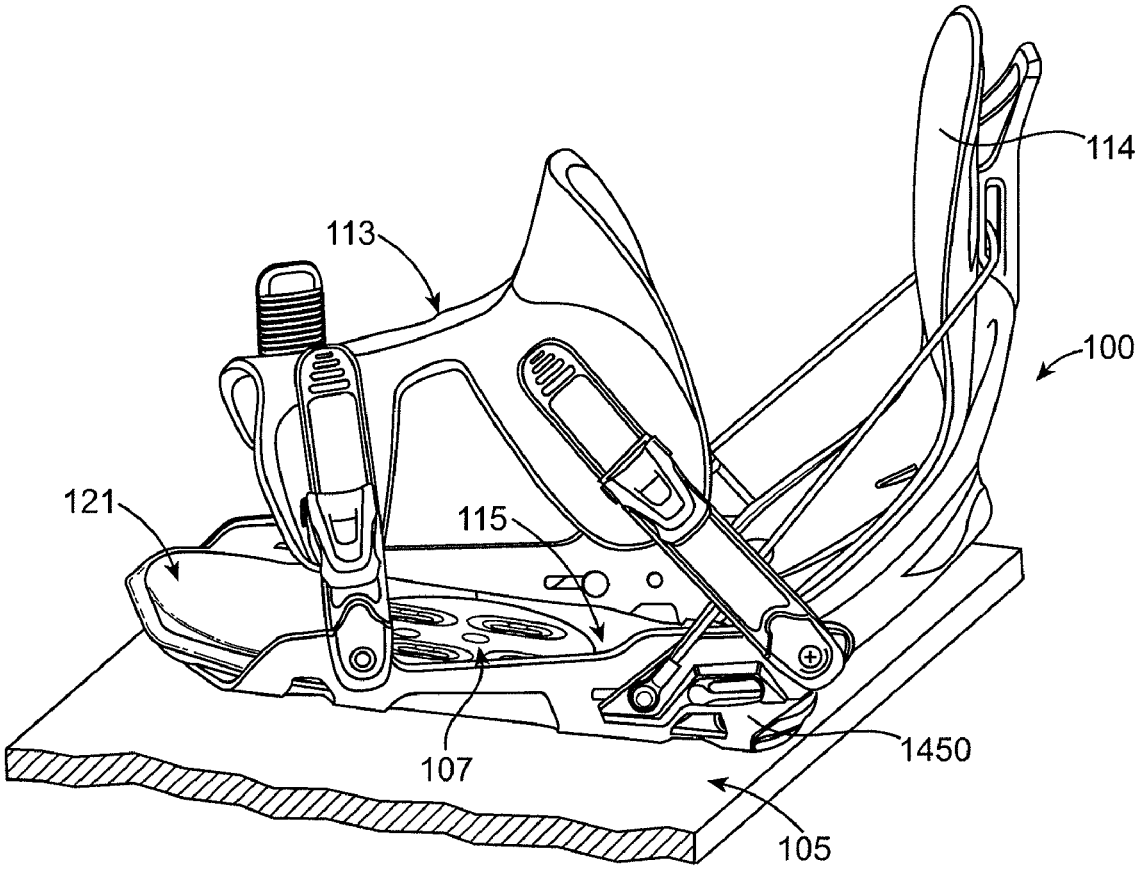
FIG. 1 shows a perspective view of a binding that can be removably attached to a snowboard via a retaining disc.

FIG. 1 shows a perspective view of a binding 100 that can be removably attached to a snowboard 105 via a retaining disc 107, which is fixed to the snowboard 105 in a well known manner. For clarity of illustration, only a portion of the snowboard 105 is shown in FIG. 1. It should be appreciated that the actual snowboard is an elongated planar member that is adapted for gliding over snow.

A snowboard boot is adapted to be removably attached to the binding 100. The binding 100 includes a chassis that provides a supporting frame or structure for the binding. The chassis includes a base plate 115 and side rails that extend upwardly from the base plate and define opposed side edges of the binding. The configuration of the chassis can vary.

The substantially planar base plate 115 is retained on a top surface of the snowboard 105 via the retaining disc 107. The base plate can be formed of a monolithic plate or it can be formed of multiple plates or parts that are fixedly or movably connected together. The binding 100 is removably attached to the snowboard 105 by coupling the base plate 115 to the retaining disc 107, as described in detail below. The binding 100 attaches to the retaining disc 107, which is fixed to the snowboard 105, to thereby attach the binding 100 to the snowboard 105. As described below, the base plate of the binding is secured between the retaining disc and the snowboard.

The binding 100 can include various components such as one or more straps or instep members that retain the boot to the binding. It should be appreciated that the boot can removably attach to the binding in any of a variety of manners and that this disclosure is not limited to the particular type of boot coupling shown herein. In an exemplary embodiment shown in FIG. 1, the binding includes a heel member comprised of a hiback 114 that extends upwardly from the base plate 115. An instep member or members can be positioned atop the boot when the boot is coupled to the binding 100. One or more straps can be used to secure the instep member 113 to the binding 100. As mentioned, the boot can be coupled to the binding in any of a variety of manners. For example, the boot can enter the binding in a rear-entry manner or it can enter the binding in a top-down manner. Furthermore, the binding 100 is not limited to having a hiback.

With reference still to FIG. 1, the binding 100 includes a movable coupler assembly having a coupler element 121 that engages the retaining disc 107 to at least partially fix the binding to the retaining disc 107 and snowboard 105. The coupler assembly optionally also includes a locking member (described below) that can be used to lock the coupler element 121 into one or more engaged positions with the retaining disc 107, as described in detail below. In an exemplary embodiment, the coupler element 121 is a planar or substantially planar member that is positioned co-planar or otherwise adjacent with a base plate of the binding. In another embodiment, the coupler element 121 is a pad or planar member that is slidably positioned on top of the base plate, as shown in FIG. 1. The pad provides a support surface for the boot. The coupler element 121 moves (such as in a sliding fashion) between engaged and disengaged states, as described below.

The coupler assembly can include one or more mechanisms that bias the coupler element toward the engaged state.

For example, a spring or other biasing member could be positioned on the binding so that the coupler assembly is urged toward the engaged state. Thus, when unopposed, the coupler element would tend to move toward a state where it engages the retaining disc 107.

In an embodiment, the coupler element 121 can move between (1) a fully engaged position wherein the coupler element engages the retaining disc 107 in a manner that completely prohibits relative movement between the base plate 115 (or other portion of the binding) and the retaining disc 107 or that prevents the binding from being lifted off of the retaining disc and snowboard; (2) a partially engaged position wherein the coupler element engages the retaining disc in a manner that prohibits the binding from being removed from the retaining disc and snowboard but still permits some movement (such as rotational movement) between the base plate 115 (or other portion of the binding) and the retaining disc 107/snowboard; and (3) a disengaged position wherein the coupler element permits the binding to be removed from the retaining disc and thus from the snowboard. Alternately, the coupler element moves only between the fully engaged position and the disengaged position or between the partially engaged position and disengaged position.

In one embodiment, when the coupler element 121 is in the fully engaged position, the coupler element 121 is positioned relative to the retaining disc 107 such that it affords a rigid connection in all spatial directions between the retaining disc 107/snowboard and the base plate 115. Alternately, the fully engaged position limits the binding from being lifted off of the retaining disc and snowboard. When fully engaged with the retaining disc 107, the coupler element 121 locks the base plate 115 to the retaining disc 107 (and the snowboard 105). Thus, the base plate 115 cannot be removed from or moved relative to the retaining disc 107 when the coupler element 121 is in the fully engaged position.

When the coupler element 121 is in the partially engaged position, the coupler element 121 affords a connection with the retaining disc 107 and snowboard that prohibits the binding 100 from being lifted off of the retaining disc 107 and snowboard but permits the base plate to move (such as in a rotational manner) relative to the retaining disc 107 and snowboard. For example, when the coupler element 121 is partially engaged, the binding 100 can be rotatably adjusted to different angular positions relative to the retaining disc 107 and the snowboard 105. In other words, when the coupler element 121 is in the partially engaged position, it enables an angle of rotation between the binding longitudinal axis and a longitudinal axis of the snowboard 105 to be changed to suit the desires of the user, after which the desired angle of rotation can be fixed by moving the coupler element to the fully engaged position.

When the coupler element 121 is in the disengaged position, the coupler element 121 does not prohibit any movement between the binding 100 and the retaining disc 107/snowboard. Thus, the binding 100 can be removed from the retaining disc 107 and the snowboard when the coupler element is disengaged.

The coupler element 121 is a component that moves relative to at least a portion of the binding to engage or disengage the retaining disc 107. The type of movement can vary and can comprise, for example, pivoting movement or sliding movement. In the illustrated embodiment, the coupler element 121 is a plate-like or partially plate-like member that slides between the engaged positions and the disengaged position, as described in more detail below. As the coupler element 121 slides, it varies the size of an orifice wherein the orifice receives the retaining disc 107. In this manner, the coupler element 121 can be slid to various positions such that the retaining disc 107 is locked within the orifice or releasable from the orifice, as described more fully below.

The coupler element 121 can be located on various regions of the binding, such as on a front region, rear region, or side regions. In the illustrated embodiment, the coupler element 121 is positioned on a front region of the binding, although the coupler element 121 can also be positioned on the rear or side regions. Moreover, the binding can include more than one coupler elements, such as a first coupler element on the front region of the binding and a second coupler element on a rear region, wherein the first and second coupler elements collectively engage or disengage the retaining disc. One coupler may have the function of partial disengagement/engagement while the second coupler may have the function of complete disengagement/engagement.

The coupler element 121 can be formed of multiple components or can be a single piece. Moreover, the binding 100 can be configured to have any type of movable part that transitions from a disengaged position to a partially engaged or fully engaged position that limits movement of the binding relative to the retaining disc. The moveable part does not have to be a sliding part, but can move in other ways.

With reference to FIG. 1, the retaining disc 107 has a shape that corresponds to the shape of the adjustably-sized orifice formed (or partially formed) by the coupler element. In the illustrated embodiment, the retaining disc 107 has a circular shape, although the retaining disc 107 can have other shapes. The retaining disc 107 can have a thickness that corresponds to the thickness of the base plate 115.

Figure 2:
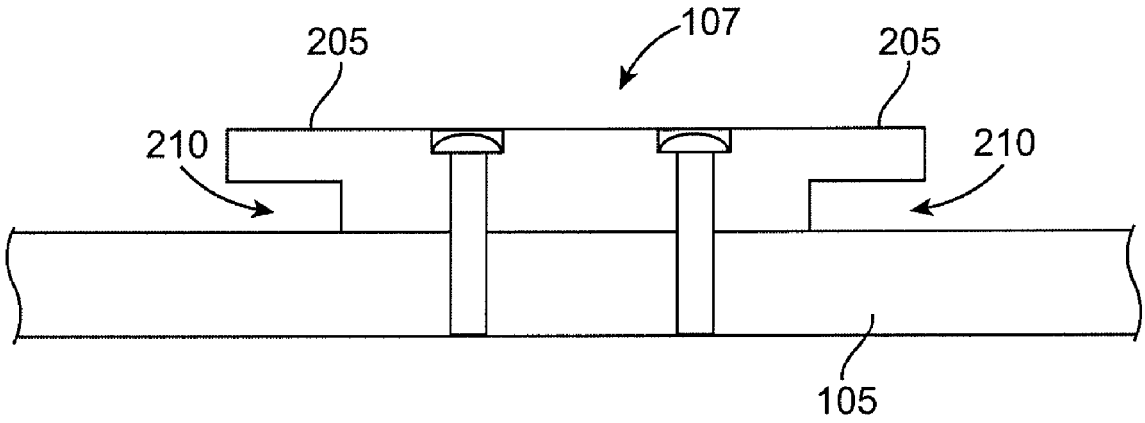
FIG. 2 shows a schematic, cross-sectional side view of the retaining disc attached to the snowboard.

FIG. 2 shows a schematic, cross-sectional side view of the retaining disc 107 attached to the snowboard 105 (of which only a portion is shown) without the binding 100 attached. FIG. 2 is not to scale and the shapes and relative dimensions may be exaggerated for clarity of illustration. The retaining disc 107 can be attached to the snowboard 105 in various manners, such as by using screws or bolts. The retaining disc 107 has a perimeter ledge or lip 205 that hangs over the snowboard 105 so as to form an annular slot 210 between the lip 205 and the snowboard 105. A portion of the base plate 115 (or a separate element positioned above or below the base plate) of the binding 100 is positioned within the annular slot 210 when the binding is secured to the retaining disc 107, as described in detail below. The retaining disc 107 can have teeth, pins, ridges, or other engagement surfaces that mate with corresponding surfaces in the base plate 115 and/or the coupler element 121 so as to limit movement between the retaining disc 107 and base plate 115, as described below. Moreover, the retaining disc 107 can have a variety of shapes and sizes. For example, the retaining disc can be cylindrical, partially-cylindrical, conical, partially conical, frustoconical, etc. in cross-section.

It should be appreciated that the retaining disc 107 is not limited to the particular shape shown in FIG. 2. The retaining disc 107 does not have to have the lip 205 but can have any shape or structure that can interface with the base plate of the binding so as to prevent the binding from being lifted off of the retaining disc when the retaining disc is mounted on the snowboard. For example, the retaining disc can have an inverted frusto-conical shape with sloped walls that include ridges that engage the base plate. The aperture in the base plate can have a complimentary frusto-conical shape with sloped walls having complimentary ridges.

With reference again to FIG. 1, when the binding 100 is attached to the retaining disc 107 and the coupler element 107 is engaged thereto, the orifice has a size and shape that substantially corresponds to the size and shape of the retaining disc 107. The retaining disc 107 is placed within the orifice such that the retaining disc 107, coupler element, and base plate 115 are joined in a positive fit. The retaining disc 107 in conjunction with the complementary orifice forms a lockable and releasable bearing for the base plate 115 relative to the top face of the snowboard 105.

An exemplary manner in which the coupler element 121 selectively engages and disengages the retaining disc is now described. It should be appreciated that the disclosure is not limited to the particular manner described herein and that other mechanisms can be used to move the coupler element between the engaged and disengaged positioned relative to the retaining disc.

Figure 3:
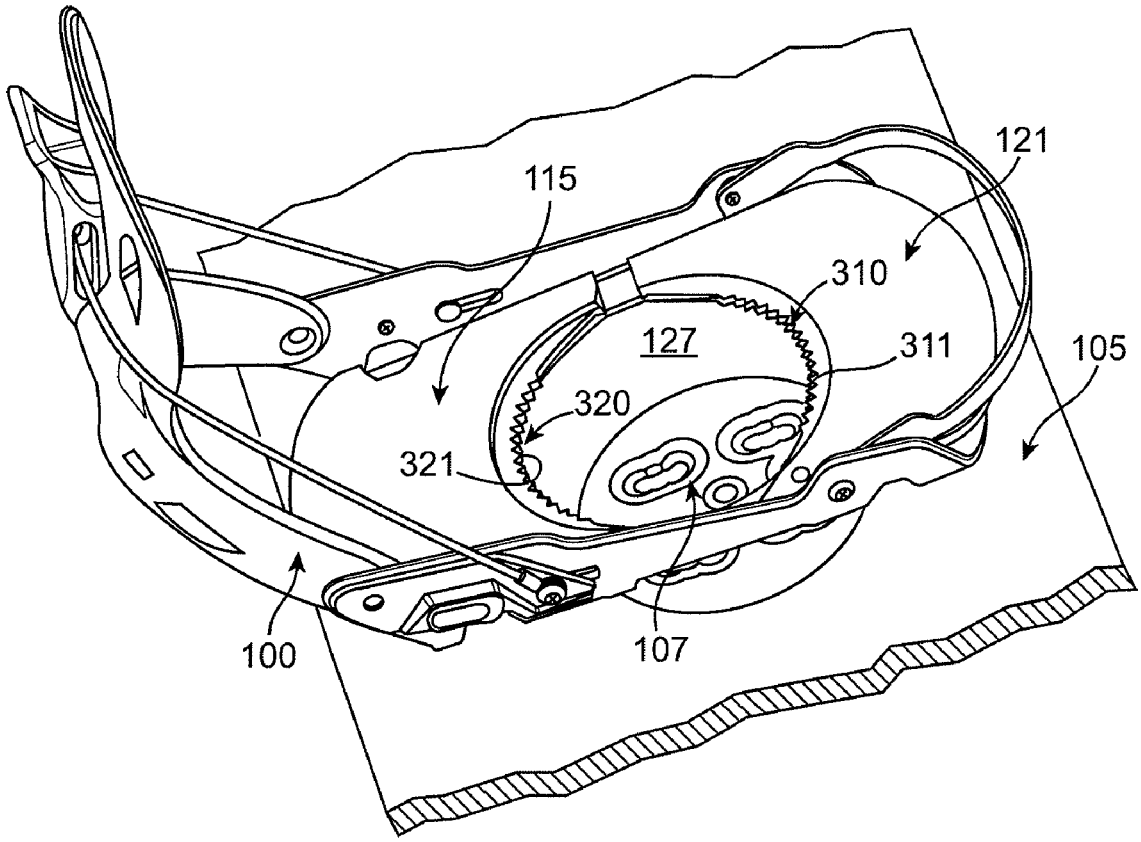
FIG. 3 shows a top perspective view of the binding, snowboard, and retaining disc.

As mentioned, the coupler element 121 can comprise a plate-like component that slides relative to the binding. FIG. 3 shows a top perspective view of the binding 100, snowboard 105, and retaining disc 107. For clarity of illustration, FIG. 3 does not show the instep member and straps. The coupler element 121 is in the disengaged position in FIG. 3 such that the orifice 127 is of a size that is larger than the outer perimeter size of the retaining disc 107. That is, the orifice 127 has a diameter that is greater than the diameter of the retaining disc 107. The coupler element 121 is slideably mounted to the binding 100, such as by a sliding engagement between the coupler element 121 and the binding's chassis, such as side members of the binding 100. In this regard, the coupler element is slidably positioned between the side members of the binding. Any of a variety of mechanisms or engagements can be used to achieve the sliding movement of the coupler element.

With reference still to FIG. 3, the coupler element 121 has an engagement region 310 that is sized and shaped to correspond to the outer contour of the retaining disc 107. The engagement region 310 can include teeth 311 or other engagement structures adapted to mate with corresponding teeth 108 or engagement structures on the retaining disc. The engagement region 310 includes a lip that is sized to fit within the annular slot 210 (FIG. 2) of the retaining disc 107, as described more fully below.

The binding includes an engagement region 320 that is sized and shaped to correspond to a portion of the retaining disc 107. The engagement region 320 can be the base plate itself or it can be a separate structure positioned above or below the base plate. In FIG. 3, the engagement region 320 is formed by a separate structure, such as a pad, on the base plate wherein the pad provides a support surface for the boot. The engagement region 320 can also include teeth 321 or engagement structures adapted to mate with corresponding teeth 108 or engagement structures on the retaining disc. The coupler element 121 slides within or adjacent to the plane of the base plate 115. The coupler element 121 can slide such that the engagement region 310 of the coupler element 121 moves toward or away from the engagement region 320 of the base plate 115. In this manner, the size of the orifice 127 can be varied, thereby locking the base plate to the retaining disc or allowing release of the base plate from the retaining disc. To remove the binding from the disc and snowboard, the coupler element 121 is slid away from the engagement region 320 of the base plate 115 to widen the orifice 127 to a size that is larger than the size of the retaining disc. To lock the base plate 115 to the retaining disc 107 and snowboard, the retaining disc 107 is positioned within the orifice 127 and the coupler element 121 is slid so as to decrease the orifice 127 to a size that achieves a locked engagement between the base plate 115, coupler element 121 and retaining disc 107/snowboard.

Figure 4:
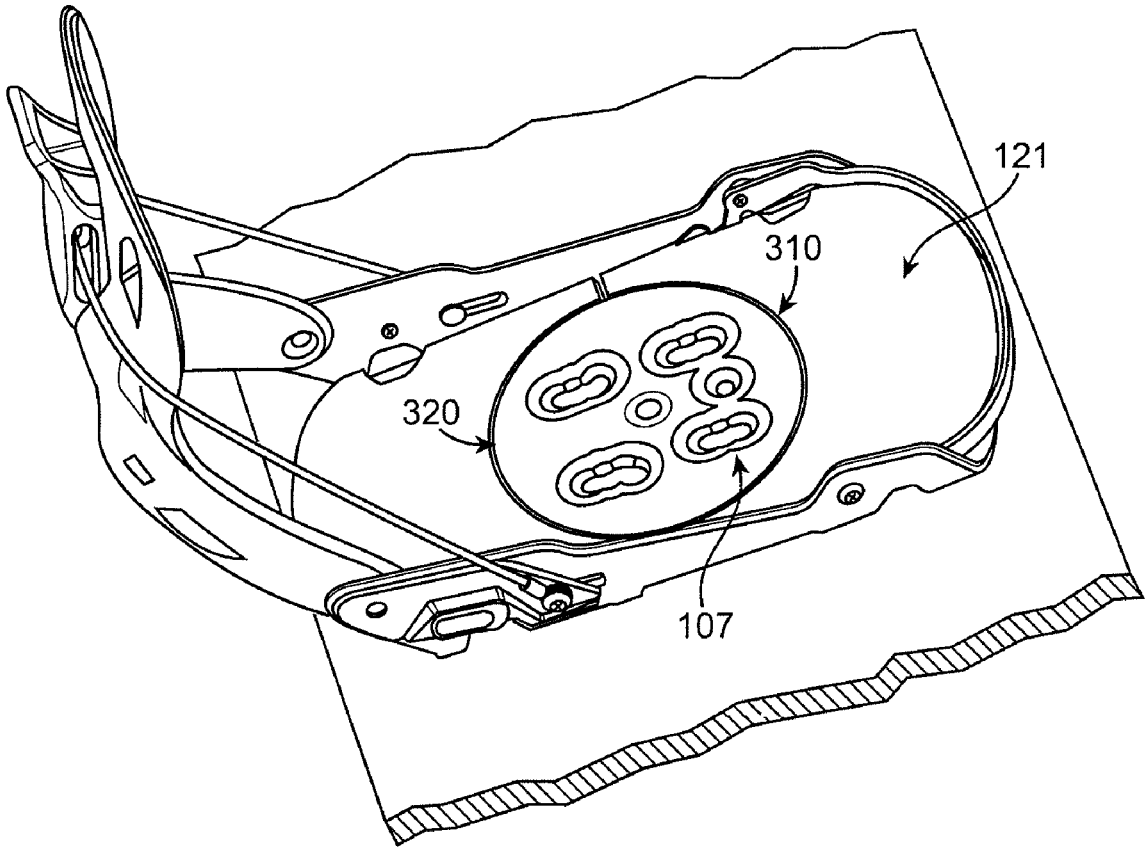
FIG. 4 shows the binding with a coupler element moved toward an engagement position.

FIG. 4 shows the binding 100 with the retaining disc 107 positioned inside the aperture formed by the coupler element. For clarity of illustration, FIG. 4 does not show the instep member and straps. The coupler element 121 is moved toward an engagement position such that the size of the orifice has decreased (relative to FIG. 4) and the engagement regions 310 and 320 are closer to engagement with the retaining disc 107. At the stage shown in FIG. 4, the coupler element 121 is still at a disengaged position such that the orifice 127 is still larger than the retaining disc 107. Thus, the binding 100 is not locked to the retaining disc 107.

Figure 5:
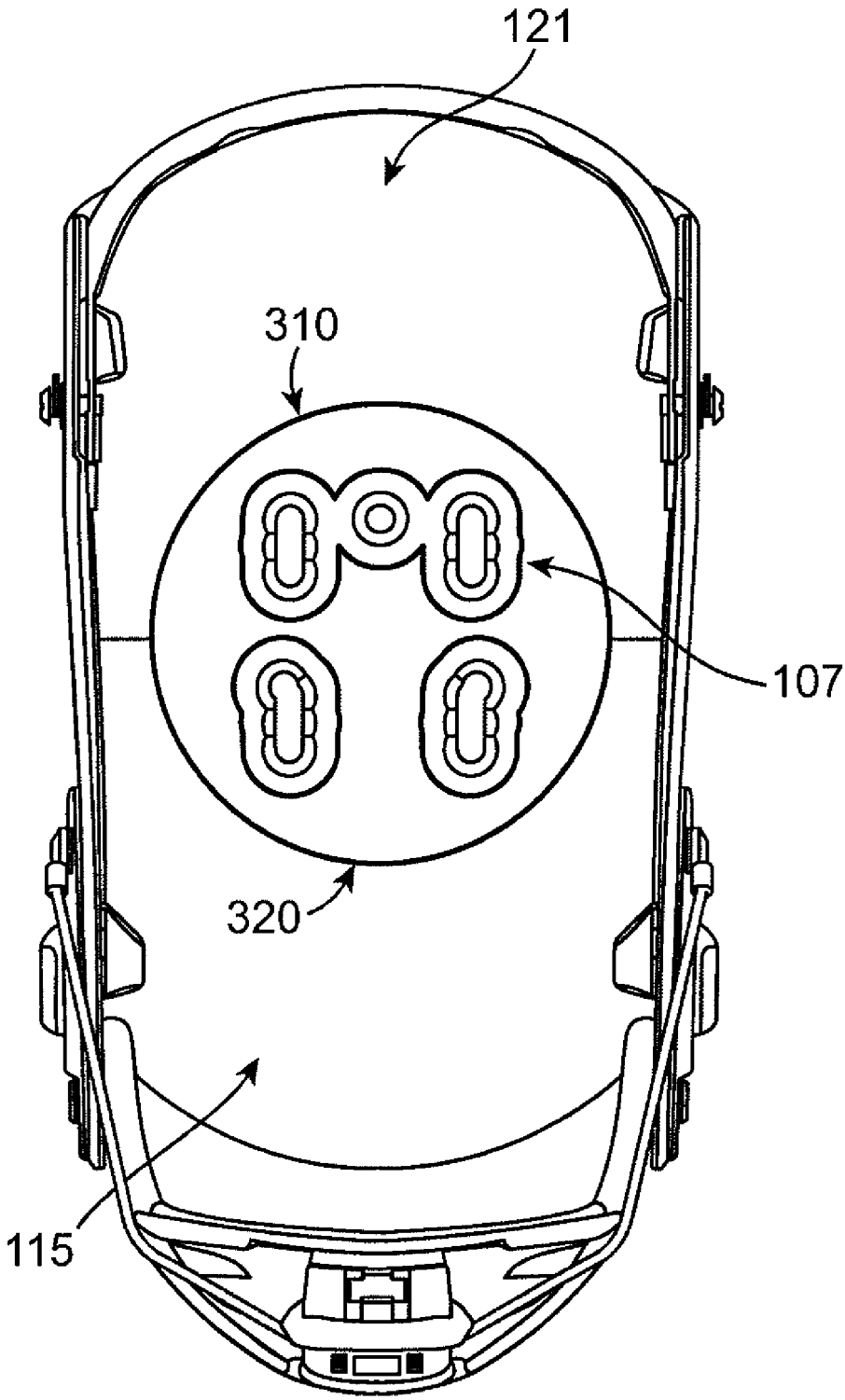
FIG. 5 shows the binding with the coupler element fully engaged with the retaining disc.

FIG. 5 shows a top, plan view of the binding 100 with the coupler element 121 fully engaged with the retaining disc 107. For clarity of illustration, FIG. 5 does not show the instep member and straps. The coupler element 121 is slid to a position such that the engagement region 310 of the coupler element 121 and the engagement region 320 of the base plate 115 are positioned flush or substantially flush against the outer edges of the retainer disc 107. The orifice is of a size that is substantially equal to or only slightly larger than the size of the retainer disc 107 such that the retainer disc 107 cannot be removed from the orifice 127. In this manner, the binding 100 is locked to the retainer disc 107 and the snowboard.

Figure 6:
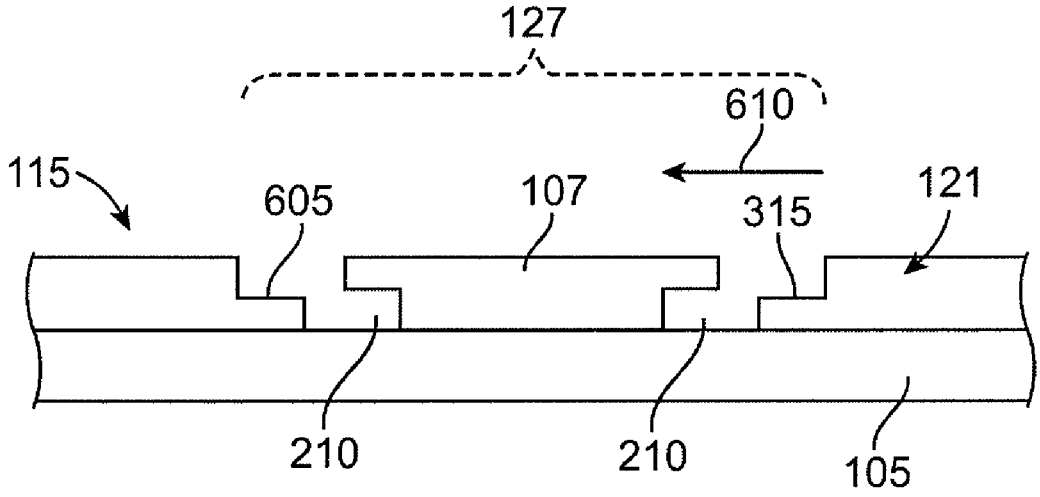
FIG. 6 shows the coupler element in a disengaged position.
Figure 7:
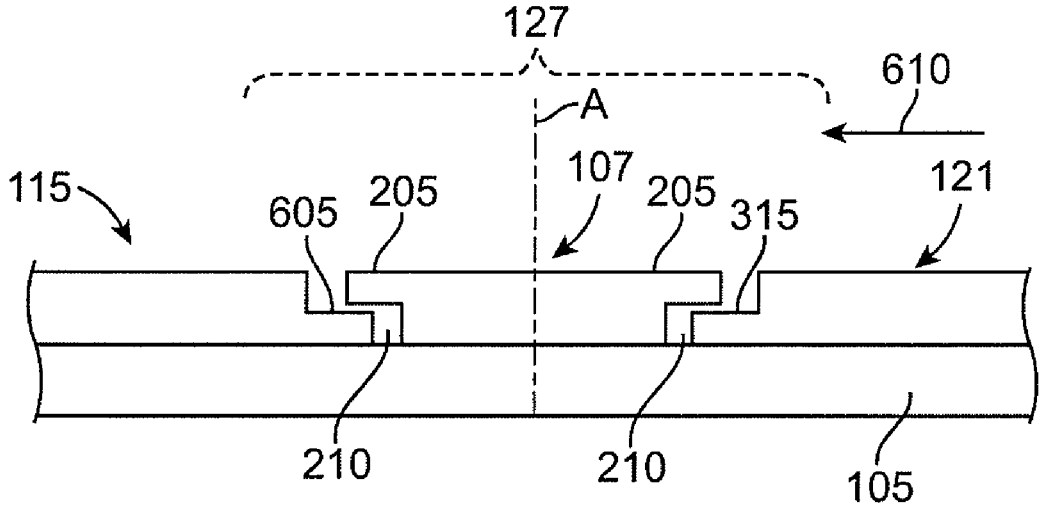
FIG. 7 shows the coupler element in a partially engaged position.
Figure 8:
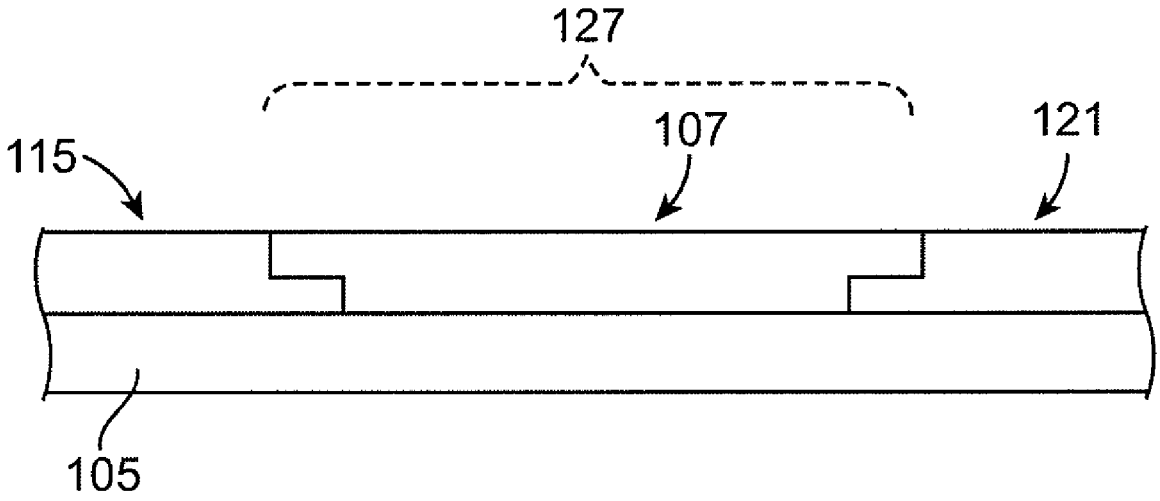
FIG. 8 shows the coupler element in a fully engaged position.

The manner in which the coupler element 121 slides from the unengaged position to the partially engaged and engaged position is now further described with reference to FIGS. 6-8, which show schematic cross-sectional views of the retaining disc 107 and the binding 100 mounted on the snowboard 105. For clarity of illustration, only a portion of the snowboard and binding are shown in FIGS. 6-8. Moreover, FIGS. 6-8 show the coupler element 121 and the base plate 115 as being in direct juxtaposed contact with the snowboard 105. As mentioned, the coupler element 121 can be a pad that is slidably positioned atop the base plate, wherein the base plate, and not the coupler element itself, directly contacts the snowboard 105.

FIG. 6 shows the coupler element 121 in the disengaged position. The coupler element 121 is positioned such that the orifice 127 has a size that is greater than the size of the outer perimeter of the retainer disc 107. Note that the base plate 115 has a lip 605 that is sized to fit within the annular slot 210 of the retainer disc 107. The coupler element 121 also has a lip 315 that is sized to fit within the annular slot 210 of the retainer disc 107. The coupler element 121 transitions toward the engaged position by sliding the coupler element 121 toward the retainer disc 107, as represented by the arrow 610. As mentioned, the coupler element 121 does not necessarily have to slide toward the engaged position but could rather move in other manners, such as in a pivoting manner. Moreover, both the coupler element 121 and the base plate 115 could move toward the retainer disc 107.

A movement mechanism, such as a cam or geared mechanism, can also be used to achieve movement of the coupler element 121. For example, the coupler element 121 can be attached to mechanism that is mounted, for example, on side railings of the binding. The mechanism can be coupled to an actuator (such as the locking member described below) such that movement or other actuation of the actuator causes the coupler element to move in a desired manner.

FIG. 7 shows the coupler element in the partially engaged position such that the coupler element 121 affords a connection with the retaining disc 107 and snowboard that prohibits the binding 100 from being lifted off of the retaining disc 107 and snowboard but permits the base plate to move (e.g., rotate) relative to the retaining disc 107. The lips 315 and 605 are positioned within the annular slot 210 below the lip 205 of the retaining disc 107. The positional relationship between the lip 205 and the lips 315/605 prevent the binding 100 from being lifted off of the retaining disc 107 and snowboard 105. However, there is still some freeplay between the retaining disc 107 and the base plate 115/coupler element 121 so as to permit some movement therebetween. The movement can be rotational movement such that the binding can rotate about an axis A relative to the retaining disc 107 and snowboard 105. The axis A is perpendicular to the plane of the retaining disc 107 and the snowboard. Such rotation enables the orientation of the binding 100 to be changed to suit the desires of the user, after which the orientation can be fixed by moving the coupler element to the fully engaged position.

The coupler element 121 is moved to the fully engage position by further sliding the coupler element 121 toward the retaining disc 107, as exhibited by the arrow 610 in FIG. 7. As this occurs, the engagement regions 310 and 320 of the coupler element 121 and base plate 315 will move toward full contact with the retainer disc 107. FIG. 8 shows the coupler element 121 in the fully engaged position with respect to the retainer disc 107. The engagement regions of the coupler element 121 and base plate 315 are in full contact with the outer edges of the retainer disc 107. Thus, the base plate and coupler element are locked relative to the retaining disc such that the binding cannot be moved relative to the retaining disc and snowboard. As mentioned, the coupler element 121 and/or the base plate 115 can have teeth 311 and/or 321 that mate with corresponding teeth 108 of the retainer disc 107 to provide a secure engagement therebetween.

Figure 9:
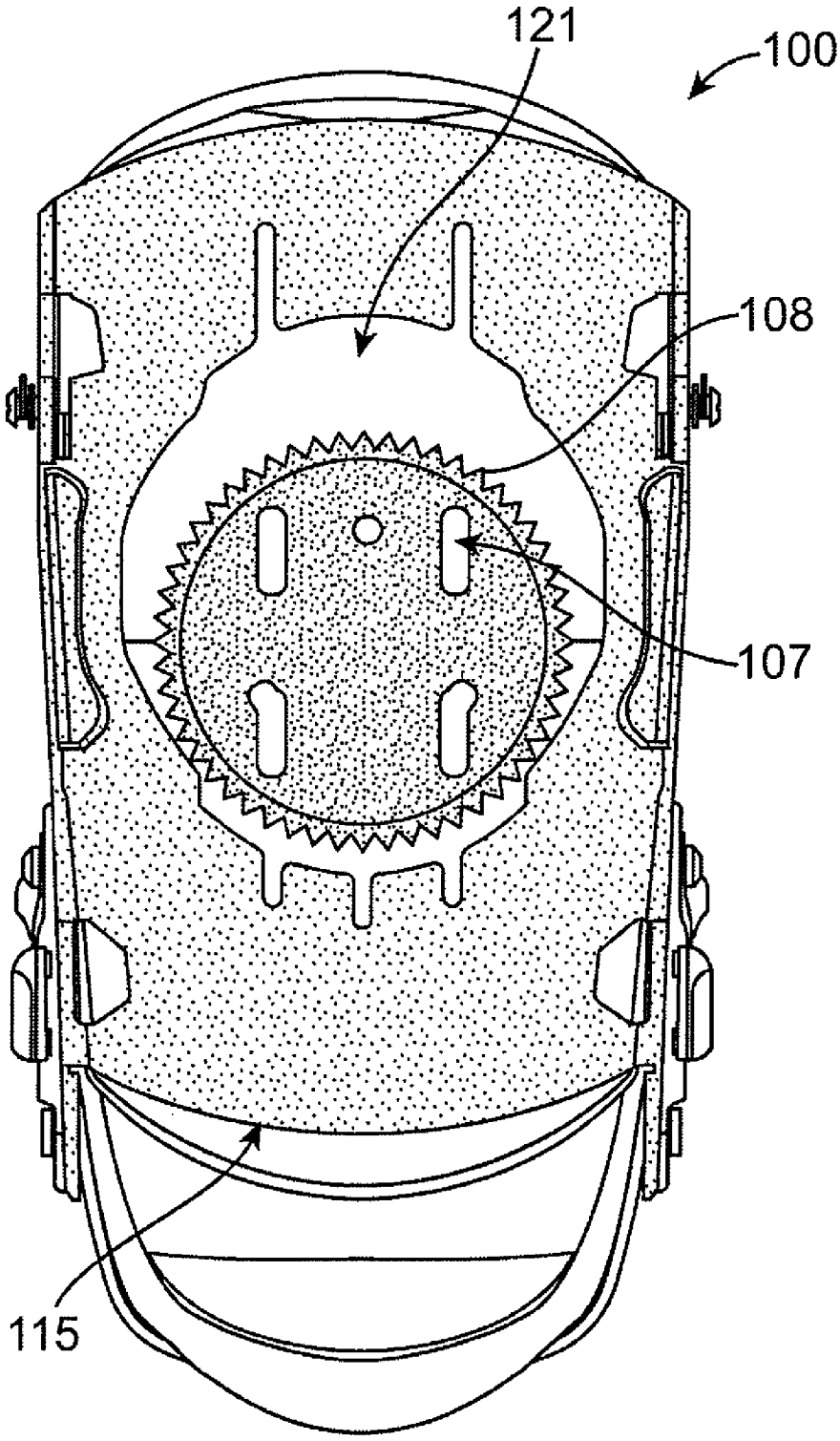
FIG. 9 shows a bottom view of the binding and the retaining disc.

FIG. 9 shows a bottom view of an embodiment of the binding 100 and the retaining disc 107 and shows an example of teeth 108 of the teethed-engagement. With the coupler element 121 fully engaged with the retainer disc 107, the binding is immobilized relative to the retainer disc 107 and the snowboard 105. Note that in FIG. 9 the base plate is a plate that extends substantially from heel to toe of the binding. The coupler element 121 is a pad slidably positioned on the base plate with the base plate having another pad that forms the engagement region of the base plate.

As mentioned, the retaining disc 107 is not limited to the particular shape shown in FIGS. 6-8. Thus, the retaining disc 107 does not have to have the lip 205 but can have any shape or structure that can interface with the board and the base plate of the binding so as to prevent the binding from being lifted off of the retaining disc when the retaining disc is mounted on the snowboard. For example, the retaining disc can have an inverted frusto-conical shape with the sloped walls that include ridges that engage the base plate. The aperture in the base plate can have a complimentary frusto-conical shape with sloped walls having complimentary ridges. Any type of base plate-retaining disc arrangement can be used that provides an interfering engagement between the base plate and retaining disc that prevents the binding from being lifted off of the retaining disc and snowboard or otherwise partially or completely prevents movement of the base plate relative to the retaining disc and snowboard.

The coupler element 121 can be disengaged from the retaining disc 107 by sliding the coupler element 121 away from the base plate 115 so as to enlarge the size of the orifice. In other words, the coupler element 121 is slid opposite the direction 610 shown in FIG. 7. With the size of the orifice increased to a size that is larger than the outer perimeter of the retaining disc 107, the binding 100 can be removed from the retaining disc 107 and the snowboard by lifting it off the retaining disc and snowboard.

It can be desirable to lock the coupler element into the engaged position in order to prevent the coupler element 121 from inadvertently moving back to the disengaged position. It would be undesirable for the coupler element to inadvertently move to the disengaged or partially engaged position during use, as this could result in the binding moving relative to the snowboard. In view of the foregoing, the binding can be equipped with a locking member or mechanism that locks the coupler element into the engaged position, as described in detail below.

Figure 10:
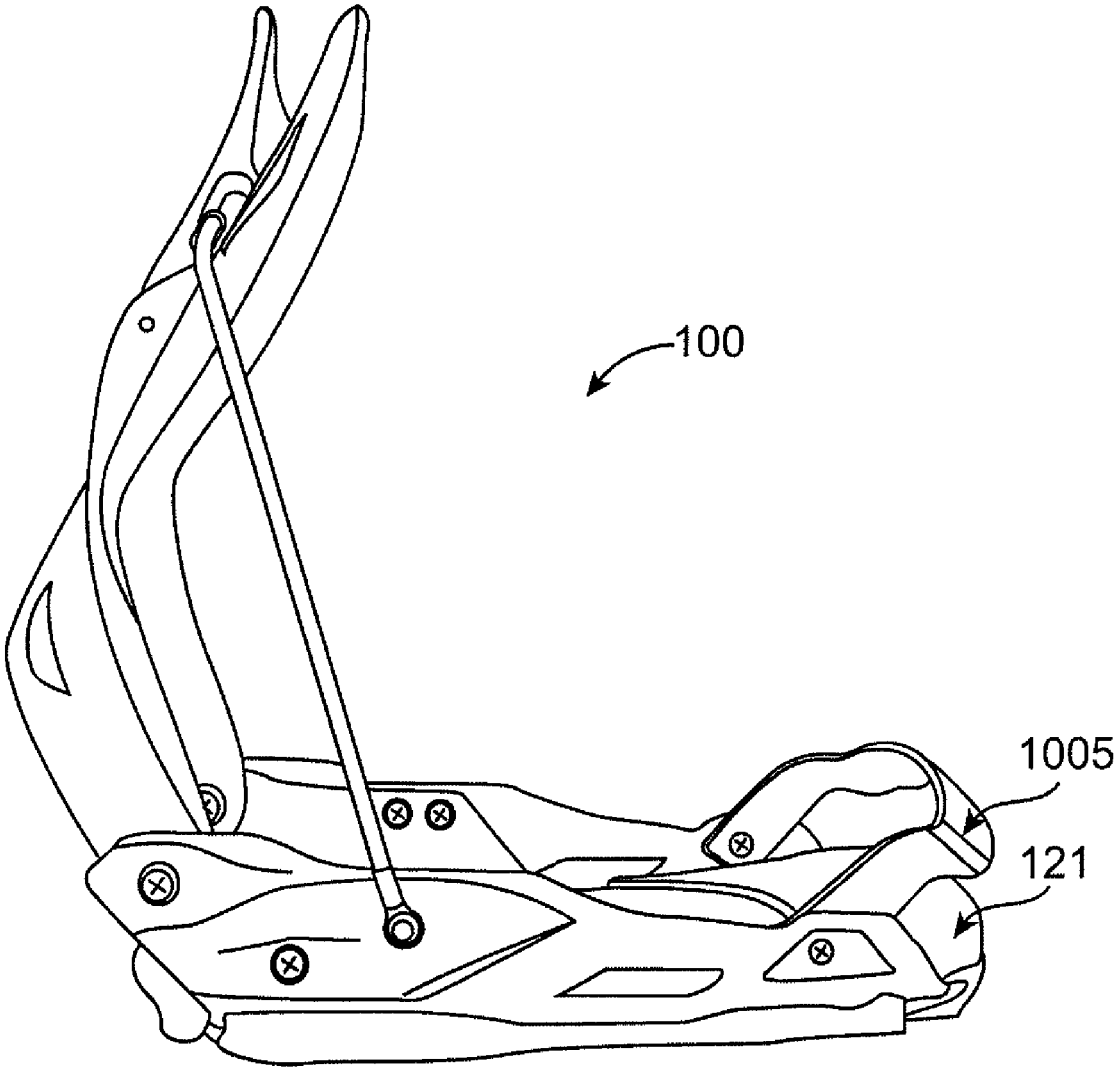
FIG. 10 shows the binding with a locking element in an unlocked state.
Figure 11:
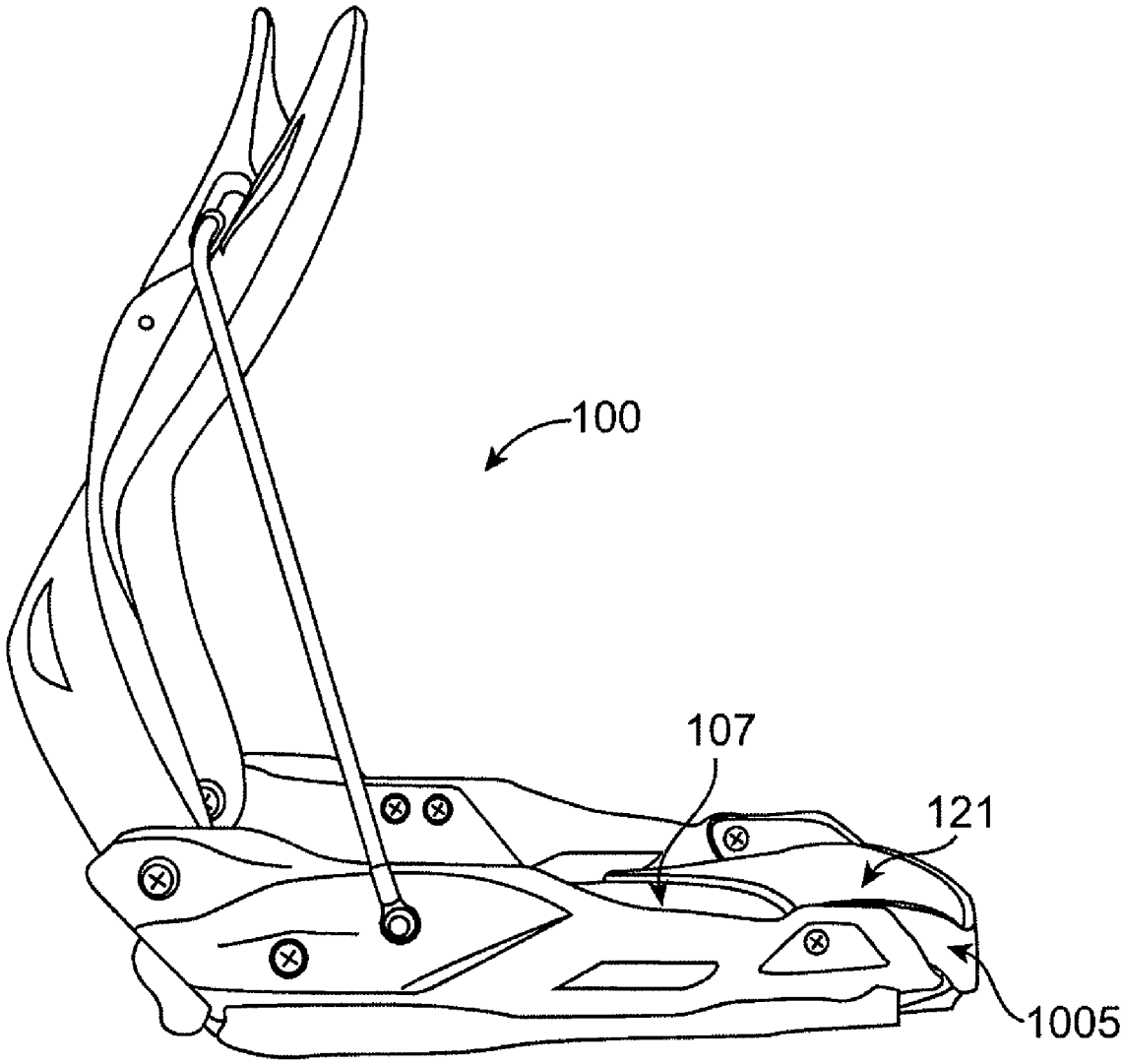
FIG. 11 shows the binding with the locking element in a locked state.

In an embodiment, the coupler assembly of the binding 100 includes a locking member that is adapted to lock the coupler element 121 into one or more engaged positions with the retaining disc 107. FIGS. 10 and 11 show an exemplary embodiment of a binding equipped with a locking member. The binding in FIGS. 10 and 11 has an alternate structure than the binding shown in FIG. 1 in that the side rails are of an alternate design. Moreover, the instep element and side straps are not shown in FIGS. 10 and 11 for clarity of illustration. It should be appreciated that the binding shown in FIGS. 10 and 11 can be equipped with one or more instep member(s) and side strap(s).

With reference to FIGS. 10 and 11, the locking member is comprised of a latch 1005. With reference to FIG. 10, the binding 100 is shown with the latch 1005 in an unlocked state or position. The latch 1005 is a component that is adapted to move between a locked state wherein the latch locks the position of the coupler element 121, and an unlocked state, wherein the latch does not lock the position of the coupler element 121. In the illustrated embodiment, the latch 1005 is a component that is pivotably attached to the binding, such as to opposite side rails of the binding. The latch 1005 has a shape that extends across the front of the binding and that complements the shape of the front edge of the coupler element 121. When the latch is unlocked, the latch 1005 does not impede movement of the coupler element 121 between the engaged and disengaged positions. The latch can be an elongate and/or contoured rod or bar or any other structure that can lock the position of the coupler element.

In an embodiment, the latch 1005 is positioned so as to prevent the boot from being positioned on the base plate of the binding when the latch 1005 is unlocked. That is, the latch prevents the boot from fully entering the binding when the latch 1005 is unlocked For example, as shown in FIG. 10, the latch 1005 is positioned upward of the coupler element 121 and above the base plate so that the latch 1005 is in the way of the boot being properly inserted onto the binding. When the boot is positioned on the binding and the latch locked, the boot prevents the latch from being moved to the unlocked position. This provides a fail-safe that prevents the latch from unlocking and the binding from disengaging from the binding while a rider is riding the snowboard.

Moreover, the binding can be equipped with a visual indicator that indicates to a user that the locking member is in the locked or unlocked state. For example, a visual indicator may have a particular color (e.g., green) when the locking member is in the locked state. The visual indicator may transition to another color (e.g., red) when the locking member is moved to the unlocked state, and vice-versa. Thus, the visual indicator may contradict or otherwise deter the user's action to attempt to secure a boot to the base plate when the locking member is unlocked.

FIG. 11 shows the latch 1005 in the locked position wherein the latch 1005 locks the coupler element 121 in the engaged position with the retainer disc 107. The latch 1005 has been pivoted downward with respect to the position shown in FIG. 10 such that the latch 1005 is entirely positioned or partially positioned forward of the coupler element 121. The latch 1005 is positioned so as to block or impede any movement of the coupler element 121 that would disengage the coupler element 121 from the retainer disc. The binding can be equipped with a secondary lock comprised of a member that can be used to secure the locking member in the locked or unlocked states. The secondary lock mechanism also can serve as a small handle to facilitate the opening of the front latch 1005.

It should be appreciated that the locking member is not limited to a latch-type mechanism. The locking member can be any component or mechanism that limits or otherwise governs movement of the coupler element 121 between the engaged and disengaged positions. Thus, the locking member does not have to be a latch that pivots between locked and unlocked positions. In addition, the locking member does not have to be attached to the side rails of the binding, but can be attached to any portion of the binding.

One example of an alternate locking mechanism is the use of a spring which maintains a continuous downward load on the latching bar.

Moreover, the movement of the locking member can optionally be coupled to the movement of the coupler element such that the coupler element automatically disengages when the locking member is unlocked or automatically moves to the engaged position as the locking member is locked. For example, in an embodiment, a mechanism, such as a cam or gear mechanism, mechanically couples the coupler element to the locking element. Thus, as the locking element is moved between the locked and unlocked states, the coupler element automatically moves between the engaged and disengaged states, and vice-versa. Thus, movement of the locking element translates to movement of the coupler element such that the locking element serves as an actuator for the coupler element. In an embodiment, pivoting or rotational movement of the locking member (or other member, not necessarily the locking member) causes linear movement of the coupler element. In another embodiment, linear movement of the locking member causes linear movement of the coupler element.

Figure 12:
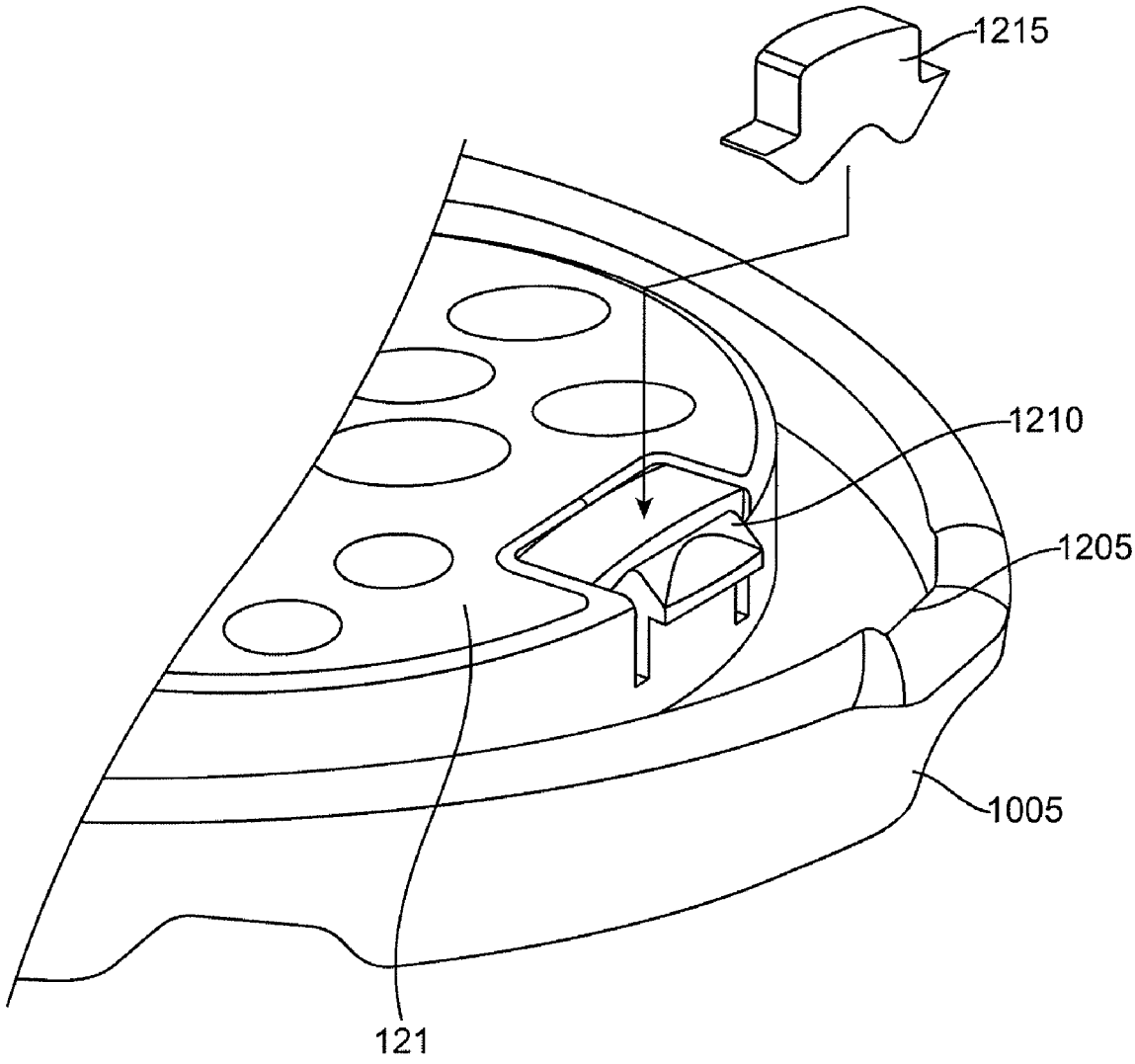
FIG. 12 shows a front region of a portion of a binding having an alternate embodiment of the locking member.

FIG. 12 shows an exploded view of the front region of the binding showing the latch 1005 and the coupler element 121. In this embodiment, the latch 1005 is a contoured bar that is shaped to complement the front edge of the coupler element 121. The latch 1005 includes a seat 1205 that engages with a secondary locking mechanism to lock the locking member (i.e., the latch 1005) in the locked state to prevent the locking member from inadvertently moving to the unlocked state from the locked state. The secondary locking mechanism includes a finger 1210 that is pivotably attached to the front edge of the coupler element 121. An elastically-deformable insert 1215 is positioned in a cavity rearward of the finger 1210 to bias the top edge of the finger 1210 toward the seat 1205 of the latch 1005. Because the insert 1215 is deformable, the finger 1210 can move in a rearward direction toward the insert 1215. This permits the latch 1005 to move downward past the finger 1210 toward the locked state Once the latch 1005 is in the locked state, the finger 1210 moves forward and engages the seat 1205 to lock the latch 1005 in the locked state.

Figure 13:
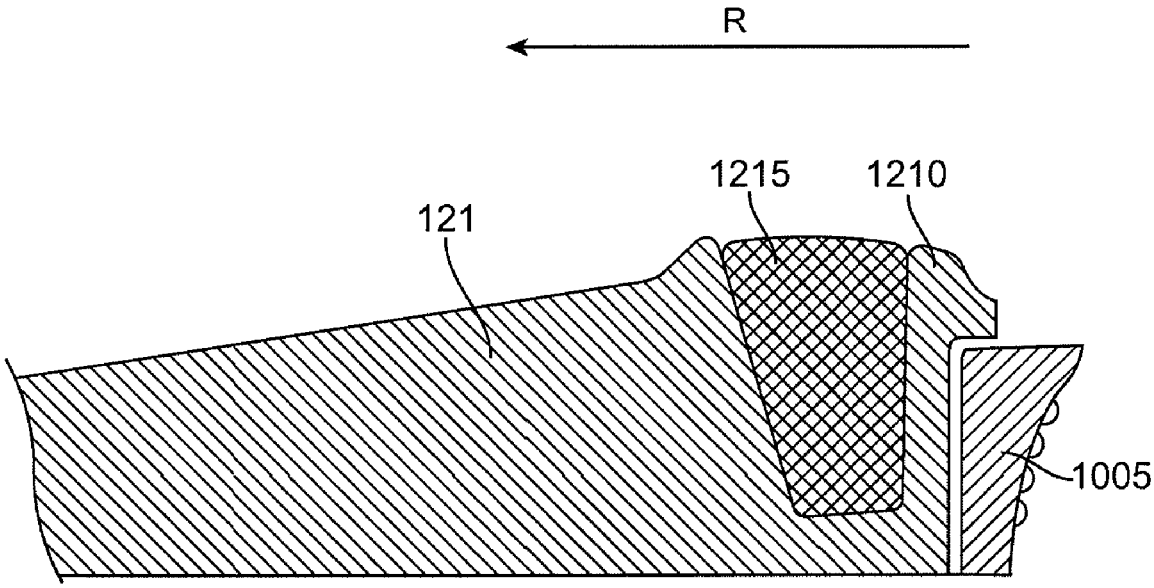
FIG. 13 shows a cross-sectional side view of the front region of the binding having the alternate embodiment of the locking member.

FIG. 13 shows a cross-sectional side view of the secondary locking member engaged with the latch 1005 while the latch 1005 is in the locked state. The finger 1210 includes an enlarged region that fits within the seat 1205. The seat 1205 and finger 1210 are shaped such that a portion of the seat 1205 overhangs the finger 1210 to prevent the latch 1005 from moving upward out of the locked state. The only way that the latch 1005 can move out of the locked state is for the operator to manually move the finger 1210 rearward (as represented by the arrow R) so that the finger 1210 moves out of the seat 1205 in the latch 1005. The latch 1005 can then be moved upward toward the unlocked state.

Adjustment of Chassis Flex and Riding Performance

In an embodiment, the chassis is a single injected part. Thus, the chassis is monolithic in that it is injection molded as a single piece. One or more portions of the chassis are configured so as to allow attachment and securement of secondary reinforcing rails or plates. This allows for a multi dimensional look using various material combinations (such as plastic chassis with machined aluminum rails). The rails or plates can be added to selected locations of the chassis to vary the structural rigidity of the chassis at those locations.

Although embodiments of various methods and devices are described herein in detail with reference to certain versions, it should be appreciated that other versions, embodiments, methods of use, and combinations thereof are also possible. Therefore the spirit and scope of the snowboard binding should not be limited to the description of the embodiments contained herein.

What is claimed is:

1. A binding for coupling a sports boot to a sport board, comprising:

a base plate adapted to be secured to the sports boot, wherein the base plate can be secured to the sport board via a retaining disc positioned on the sport board;

a coupler element to movably couple to the base plate, wherein the coupler element transitions between an engaged state wherein the coupler element provides an interfering engagement between the base plate and retaining disc to prevent the binding from being decoupled from the retaining disc and the sport board, and a disengaged state wherein the coupler element is free from the retaining disc such that the binding can be moved independently of the retaining disc and the sport board; and a locking member coupled to the coupler element, wherein the locking member transitions between a locked state wherein the coupler element is locked in the engaged state, and an unlocked state wherein the coupler element can freely move between the engaged and disengaged states, and wherein the locking member prohibits the sports boot from fully entering the binding when the locking member is in the unlocked state.

2. A binding as in claim 1, wherein the engaged state includes:

(a) a fully engaged state wherein the coupler element provides an interfering engagement between the base plate and retaining disc in a manner that completely prohibits relative movement between the base plate and the retaining disc;

(b) a partially engaged state wherein the coupler element provides an interfering engagement between the base plate and retaining disc in a manner that prohibits the base plate from being removed from the retaining disc but still permits at least some movement between the base plate and the retaining disc.

3. A binding as in claim 2, wherein the disengaged state of the coupler element allows the base plate to be removed from the retaining disc.

4. A binding as in claim 2, wherein the binding can rotate relative to the retaining disc when the coupler element is in the partially-engaged state.

5. A binding as in claim 1, further comprising a secondary lock coupled to the locking member, wherein the secondary lock transitions between (1) a first state that locks the locking member in the locked state, and (2) a second state that permits the locking member to move between the locked and unlocked state.

6. A binding as in claim 5, wherein the secondary lock connects the locking member to the coupler element wherein the secondary lock comprises a rotating element positioned in such a way that an engagement surface between the secondary lock and either the locking member or the coupler element is created when the locking member is in the locked position.

7. A binding as in claim 1, wherein the locking member provides an indicator that deters a user from attempting to secure the sports boot to the binding when the locking member is in the unlocked state.

8. A binding as in claim 1, wherein the locking member cannot be moved from the locked state to the unlocked state when the sports boot is secured to the base plate.

9. A binding as in claim 1, wherein movement of the locking member causes movement of the coupler element between the engaged and disengaged states.

10. A binding as in claim 1, wherein the coupler element moves in a sliding motion as it transitions between the engaged and disengaged states.

11. A binding as in claim 1, wherein the coupler element is a pad slidably disposed on the base plate.

12. A binding as in claim 1, wherein the locking member is a lever pivotably mounted on the base plate, wherein ends of the locking member are coupled with the coupler element.

13. A binding for coupling a sports boot to a sport board, comprising:

a base plate adapted to be secured to the sports boot, wherein the base plate can be secured to the sport board via a retaining disc positioned on the sport board; and an orifice at least partially defined by the base plate, the orifice adapted to receive the retaining disc, wherein the size of the orifice can be adjusted so as to decrease the size of the orifice to a size that achieves a locked engagement between the base plate and the retaining disc;

a locking member coupled to the base plate, wherein the locking member can transition to a state that locks the size of the orifice so that the retaining disc is secured to the base plate; and a sliding plate or flange that adjusts the size of the orifice, wherein the base plate comprises a first base plate portion and a second base plate portion that are slidably coupled to one another for adjusting the size of the orifice;

and wherein the size of the orifice can be adjusted between at least:

(a) a first size wherein the base plate is completely immobilized relative to the retaining disc;

(b) a second size wherein the base plate cannot be removed from the retaining disc but the base plate can rotate relative to the retaining disc.

14. A binding as in claim 13, wherein the base plate comprises a bottom plate and a pad positioned atop the bottom plate wherein the pad provides a support surface for the sports boot.

15. A binding as in claim 13, wherein the retaining disc has an annular slot and both the base plate and a coupler element each have a lip, which engages the annular slot in a fully engaged state and in a partially engaged state, whereas the lips are free from the slot in a disengaged state.

16. A binding as in claim 15, wherein the retaining disc comprises teeth arranged above the slot and the base plate and the coupler element have corresponding teeth around the orifice, said teeth of the retaining disc being in contact with the teeth of the base plate and the teeth of the coupler element in said fully engaged state and being out of contact in the partially engaged state and in the disengaged state.

17. A binding for coupling a sports boot to a sport board, comprising:

a base plate adapted to be secured to the sports boot, wherein the base plate can be secured to the sport board via a retaining disc positioned on the sport board;

a coupler element to movably couple to the base plate, wherein the coupler element transitions between an engaged state and a disengaged state, wherein in the engaged state the coupler element provides an interfering engagement between the base plate and retaining disc to prevent the binding from being decoupled from the retaining disc and the sport board, and wherein in the disengaged state the coupler element is free from the retaining disc such that the binding can be moved independently of the retaining disc and the sport board and the disengaged state of the coupler element allows the base plate to be removed from the retaining disc; and a locking member coupled to the coupler element, wherein the locking member transitions between a locked state wherein the coupler element is locked in the engaged state, and an unlocked state wherein the coupler element can freely move between the engaged and disengaged states, wherein the engaged state further includes:

(a) a fully engaged state wherein the coupler element provides an interfering engagement between the base plate and retaining disc in a manner that completely prohibits relative movement between the base plate and the retaining disc; and (b) a partially engaged state wherein the coupler element provides an interfering engagement between the base plate and retaining disc in a manner that prohibits the base plate from being removed from the retaining disc but still permits at least some movement between the base plate and the retaining disc.

18. A binding for coupling a sports boot to a sport board, comprising:

a base plate adapted to be secured to the sports boot, wherein the base plate can be secured to the sport board via a retaining disc positioned on the sport board;

a coupler element to movably couple to the base plate, wherein the coupler element transitions between an engaged state wherein the coupler element provides an interfering engagement between the base plate and retaining disc to prevent the binding from being decoupled from the retaining disc and the sport board, and a disengaged state wherein the coupler element is free from the retaining disc such that the binding can be moved independently of the retaining disc and the sport board;

a locking member coupled to the coupler element, wherein the locking member transitions between a locked state wherein the coupler element is locked in the engaged state, and an unlocked state wherein the coupler element can freely move between the engaged and disengaged states; and a secondary lock coupled to the locking member, wherein the secondary lock transitions between (1) a first state that locks the locking member in the locked state, and (2) a second state that permits the locking member to move between the locked and unlocked state, wherein the secondary lock connects the locking member to the coupler element wherein the secondary lock comprises a rotating element positioned in such a way that an engagement surface between the secondary lock and either the locking member or the coupler element is created when the locking member is in the locked position.

19. A binding for coupling a sports boot to a sport board, comprising:

a base plate adapted to be secured to the sports boot, wherein the base plate can be secured to the sport board via a retaining disc positioned on a sports the sport board;

a coupler element to movably couple to the base plate, wherein the coupler element transitions between an engaged state wherein the coupler element provides an interfering engagement between the base plate and retaining disc to prevent the binding from being decoupled from the retaining disc and the sport board, and a disengaged state wherein the coupler element is free from the retaining disc such that the binding can be moved independently of the retaining disc and the sport board; and a locking member coupled to the coupler element, wherein the locking member transitions between a locked state wherein the coupler element is locked in the engaged state, and an unlocked state wherein the coupler element can freely move between the engaged and disengaged states, wherein the locking member cannot be moved from the locked state to the unlocked state when the sports boot is secured to the base plate.

20. A binding for coupling a sports boot to a sport board, comprising:

a base plate adapted to be secured to the sports boot, wherein the base plate can be secured to the sport board via a retaining disc positioned on the sport board;

an orifice at least partially defined by the base plate, the orifice adapted to receive the retaining disc, wherein the size of the orifice can be adjusted so as to decrease the size of the orifice to a size that achieves a locked engagement between the base plate and the retaining disc; and a locking member coupled to the base plate, wherein the locking member can transition to a state that locks the size of the orifice so that the retaining disc is secured to the base plate, wherein the base plate comprises a first base plate portion and a second base plate portion that are slidably coupled to one another for adjusting the size of the orifice, and wherein the size of the orifice can be adjusted between at least:

(a) a first size wherein the base plate is completely immobilized relative to the retaining disc; and (b) a second size wherein the base plate cannot be removed from the retaining disc but the base plate can rotate relative to the retaining disc.

* * * * *